US011341919B2

(12) United States Patent
Xuan et al.

(10) Patent No.: US 11,341,919 B2
(45) Date of Patent: May 24, 2022

(54) DRIVE CIRCUIT, DRIVING METHOD THEREFOR, AND DISPLAY DEVICE

(71) Applicant: BOE Technology Group Co., Ltd., Beijing (CN)

(72) Inventors: Minghua Xuan, Beijing (CN); Han Yue, Beijing (CN); Qi Qi, Beijing (CN); Jing Liu, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/287,536

(22) PCT Filed: Aug. 31, 2020

(86) PCT No.: PCT/CN2020/112516

§ 371 (c)(1),
(2) Date: Apr. 22, 2021

(87) PCT Pub. No.: WO2021/043102

PCT Pub. Date: Mar. 11, 2021

(65) Prior Publication Data

US 2021/0375210 A1 Dec. 2, 2021

(30) Foreign Application Priority Data

Sep. 3, 2019 (CN) ..... 201910827559.4

(51) Int. Cl.
*G09G 3/3258* (2016.01)
*G09G 3/3266* (2016.01)
*G09G 3/3233* (2016.01)

(52) U.S. Cl.
CPC ..... *G09G 3/3258* (2013.01); *G09G 3/3266* (2013.01); *G09G 3/3233* (2013.01);
(Continued)

(58) Field of Classification Search
CPC .. G09G 3/3258; G09G 3/3266; G09G 3/3233; G09G 2300/043;
(Continued)

(56) References Cited

U.S. PATENT DOCUMENTS

2008/0036704 A1 2/2008 Kim et al.
2009/0051628 A1 2/2009 Kwon
(Continued)

FOREIGN PATENT DOCUMENTS

CN 101123071 A 2/2008
CN 101373578 A 2/2009
(Continued)

OTHER PUBLICATIONS

International Search Report for PCT/CN2020/112516 dated Nov. 30, 2020.
(Continued)

*Primary Examiner* — Tom V Sheng
(74) *Attorney, Agent, or Firm* — Ling Wu; Stephen Yang; Ling and Yang Intellectual Property

(57) ABSTRACT

Disclosed are a drive circuit, a driving method therefor, and a display device. The drive circuit is configured to drive a device to be driven to work; the drive circuit and said device are connected in series between a first working voltage end (VL1) and a second working voltage end (VL2); the drive circuit is configured to control formation of a current path between the first working voltage end (VL1) and the second working voltage end (VL2); the drive circuit comprises a drive sub-circuit, a writing sub-circuit, a compensation sub-circuit, and a gray-scale control sub-circuit, wherein the compensation sub-circuit is separately connected to the first working voltage end (VL1), a first scan signal end (G_A), a first node (N1), and a third node (N3) and is configured to compensate for the first node (N1) under control of the first scan signal end (G_A) and the first working voltage end (VL1).

20 Claims, 12 Drawing Sheets

(52) U.S. Cl.
CPC ..... *G09G 2300/043* (2013.01); *G09G 2300/0819* (2013.01); *G09G 2300/0861* (2013.01); *G09G 2300/0876* (2013.01); *G09G 2310/0275* (2013.01); *G09G 2320/043* (2013.01); *G09G 2320/045* (2013.01)

(58) Field of Classification Search
CPC ... G09G 2300/0876; G09G 2300/0819; G09G 2300/0861; G09G 2310/0275; G09G 2320/043; G09G 2320/045
USPC ..... 345/204
See application file for complete search history.

(56) References Cited

U.S. PATENT DOCUMENTS

| | | | | |
|---|---|---|---|---|
| 2013/0057532 | A1 | 3/2013 | Lee et al. | |
| 2013/0127923 | A1* | 5/2013 | An | G09G 5/10 345/690 |
| 2015/0170569 | A1 | 6/2015 | Han et al. | |
| 2020/0035145 | A1* | 1/2020 | Tseng | G09G 3/3406 |
| 2020/0098305 | A1* | 3/2020 | Yang | G09G 3/32 |
| 2020/0135104 | A1 | 4/2020 | Hou et al. | |
| 2020/0273406 | A1* | 8/2020 | Xu | G09G 3/3258 |
| 2020/0357332 | A1* | 11/2020 | Hung | G09G 3/32 |
| 2021/0233461 | A1* | 7/2021 | Yue | G09G 3/32 |
| 2021/0327347 | A1* | 10/2021 | Xu | G09G 3/3291 |
| 2021/0366396 | A1* | 11/2021 | Xuan | G09G 3/325 |

FOREIGN PATENT DOCUMENTS

| | | | |
|---|---|---|---|
| CN | 203288217 | U | 11/2013 |
| CN | 108172171 | A | 6/2018 |
| CN | 108538241 | A | 9/2018 |
| CN | 110491335 | A | 11/2019 |
| EP | 3816978 | A1 | 5/2021 |

OTHER PUBLICATIONS

Office Action dated Jun. 17, 2020 for Chinese Patent Application No. 201910827559.4 and English Translation.
Office Action dated Sep. 24, 2020 for Chinese Patent Application No. 201910827559.4 and English Translation.
Decision of Rejection dated Dec. 23, 2020 for Chinese Patent Application No. 201910827559.4 and English Translation.

* cited by examiner

DRIVE CIRCUIT, DRIVING METHOD THEREFOR, AND DISPLAY DEVICE

CROSS-REFERENCE TO RELATED APPLICATIONS

The present application is a U.S. National Phase Entry of International Application No. PCT/CN2020/112516 having an international filing date of Aug. 31, 2020, which claims priority of Chinese Patent Application No. 201910827559.4 filed to the CNIPA on Sep. 3, 2019. The above-identified applications are incorporated into this application by reference in their entirety.

TECHNICAL FIELD

Embodiments of the present disclosure relate to, but are not limited to, the technical field of display, in particular to a driving circuit, a driving method thereof and a display device.

BACKGROUND

In Micro Light Emitting Diode (Micro LED) technology, micro-sized LED arrays are integrated on a chip in a high density, to realize thin-film, miniaturization and matrixing of LED. A distance between pixels of the micro-sized LED array can reach a micron level, and each pixel can be addressed and emit light independently. A Micro LED display panel has gradually developed towards a display panel for a consumer terminal due to its characteristics, such as low driving voltage, long life, wide temperature tolerance.

SUMMARY

The following is a summary of subject matter described in detail herein. This summary is not intended to limit the protection scope of the claims.

An embodiment of the present disclosure provides a driving circuit for driving an element to be driven to work. The driving circuit and the element to be driven are connected in series between a first working voltage terminal and a second working voltage terminal, and the driving circuit is configured to control formation of a current path between the first working voltage terminal and the second working voltage terminal; the driving circuit includes a driving sub-circuit, a writing sub-circuit, a compensation sub-circuit and a gray scale control sub-circuit. The driving sub-circuit is connected with a first node, a second node, and a third node respectively, and is configured to provide a driving current to the third node under control of the first node and the second node. The writing sub-circuit is connected with a first scanning signal terminal, a first data signal terminal and the second node respectively, and is configured to write a signal of the first data signal terminal into the second node under control of the first scanning signal terminal. The compensation sub-circuit is connected with the first working voltage terminal, the first scanning signal terminal, the first node and the third node respectively, and is configured to compensate the first node under control of the first scanning signal terminal and the first working voltage terminal. The gray scale control sub-circuit is connected with a driving control signal terminal, the first working voltage terminal, the second node, the third node, a fourth node, a second scanning signal terminal, the second data signal terminal and a first voltage terminal, respectively, and is configured to provide a driving current to the fourth node under control of the driving control signal terminal, the second scanning signal terminal and the second data signal terminal to control a turned-on duration of the current path.

In some possible implementations, the driving circuit further includes a reset sub-circuit; the reset sub-circuit is connected with a reset control signal terminal, a reset voltage terminal and the first node respectively, and is configured to write a signal of the reset voltage terminal into the first node under control of the reset control signal terminal.

In some possible implementations, the reset sub-circuit includes a first transistor, and the writing sub-circuit includes a second transistor, wherein: a control electrode of the first transistor is connected with the reset control signal terminal, a first electrode of the first transistor is connected with the reset voltage terminal, and a second electrode of the first transistor is connected with the first node; a control electrode of the second transistor is connected with the first scanning terminal, a first electrode of the second transistor is connected with the first data signal terminal, and a second electrode of the second transistor is connected with the second node.

In some possible implementations, the element to be driven is a micro light emitting diode, an anode of the element to be driven is connected with the fourth node, and a cathode of the element to be driven is connected with the second working voltage terminal.

In some possible implementations, the compensation sub-circuit includes a third transistor, a first capacitor and a second capacitor, wherein: a control electrode of the third transistor is connected with the first scanning signal terminal, a first electrode of the third transistor is connected with the first node, and a second electrode of the third transistor is connected with the third node; one terminal of the first capacitor is connected with the first node, and the other terminal of the first capacitor is connected with the first working voltage terminal; one terminal of the second capacitor is connected with the first node, and the other terminal of the second capacitor is connected with the first scanning signal terminal.

In some possible implementations, the driving sub-circuit includes a driving transistor, a control electrode of the driving transistor is connected with the first node, a first electrode of the driving transistor is connected with the second node, and a second electrode of the driving transistor is connected with the third node.

In some possible implementations, the gray scale control sub-circuit includes a first control sub-circuit and a second control sub-circuit. The first control sub-circuit is connected with the first working voltage terminal, the driving control signal terminal, the second node, the third node and a fifth node respectively, and is configured to provide a signal of the first working voltage terminal to the second node and a signal of the third node to the fifth node under control of the driving control signal terminal. The second control sub-circuit is connected with the fourth node, the fifth node, the second scanning signal terminal, the second data signal terminal and the first voltage terminal respectively, and is configured to provide a signal of the fifth node to the fourth node under control of the second scanning signal terminal and the second data signal terminal.

In some possible implementations, the first control sub-circuit includes a fourth transistor and a fifth transistor, wherein: a control electrode of the fourth transistor is connected with the driving control signal terminal, a first electrode of the fourth transistor is connected with the first working voltage terminal, and a second electrode of the fourth transistor is connected with the second node; a control electrode of the fifth transistor is connected with the driving control signal terminal, a first electrode of the fifth transistor is connected with the third node, and a second electrode of the fifth transistor is connected with the fourth node.

In some possible implementations, the second control sub-circuit includes a sixth transistor, a third capacitor and a seventh transistor, wherein: a control electrode of the sixth transistor is connected with the second scanning signal terminal, a first electrode of the sixth transistor is connected with the second data signal terminal, and a second electrode of the sixth transistor is connected with a sixth node; one terminal of the third capacitor is connected with the sixth node, and the other terminal of the third capacitor is connected with the first working voltage terminal; a control electrode of the seventh transistor is connected with the sixth node, a first electrode of the seventh transistor is connected with the fourth node, and a second electrode of the seventh transistor is connected with the fifth node.

In some possible implementations, the reset sub-circuit includes a first transistor; the writing sub-circuit includes a second transistor; the compensation sub-circuit includes a third transistor, a first capacitor and a second capacitor; and the driving sub-circuit includes a driving transistor; the first control sub-circuit includes a fourth transistor and a fifth transistor; and the second control sub-circuit includes a sixth transistor, a third capacitor and a seventh transistor. A control electrode of the first transistor is connected with a reset control signal terminal, a first electrode of the first transistor is connected with a reset voltage terminal, and a second electrode of the first transistor is connected with the first node. A control electrode of the second transistor is connected with the first scanning signal terminal, a first electrode of the second transistor is connected with the first data signal terminal, and a second electrode of the second transistor is connected with the second node. A control electrode of the third transistor is connected with the first scanning signal terminal, a first electrode of the third transistor is connected with the first node, and a second electrode of the third transistor is connected with the third node. One terminal of the first capacitor is connected with the first node, and the other terminal of the first capacitor is connected with the first working voltage terminal. One terminal of the second capacitor is connected with the first node, and the other terminal of the second capacitor is connected with the first scanning signal terminal. A control electrode of the driving transistor is connected with the first node, a first electrode of the driving transistor is connected with the second node, and a second electrode of the driving transistor is connected with the third node. A control electrode of the fourth transistor is connected with the driving control signal terminal, a first electrode of the fourth transistor is connected with the first working voltage terminal, and a second electrode of the fourth transistor is connected with the second node. A control electrode of the fifth transistor is connected with the driving control signal terminal, a first electrode of the fifth transistor is connected with the third node, and a second electrode of the fifth transistor is connected with the fifth node. A control electrode of the sixth transistor is connected with the second scanning signal terminal, a first electrode of the sixth transistor is connected with the second data signal terminal, and a second electrode of the sixth transistor is connected with a sixth node. One terminal of the third capacitor is connected with the sixth node, and the other terminal of the third capacitor is connected with the first working voltage terminal. A control electrode of the seventh transistor is connected with the sixth node, a first electrode of the seventh transistor is connected with the fifth node, and a second electrode of the seventh transistor is connected with the fourth node.

In some possible implementations, the first capacitor and the second capacitor satisfy $C2/(C1+C2)=\Delta V/\Delta Vg$; wherein C1 is a capacitance value of the first capacitor, C2 is a capacitance value of the second capacitor, $\Delta V$ is a difference between an actual voltage value and an ideal voltage value of the first node after the first node is compensated, and $\Delta Vg$ is a kickback voltage value of the first scanning signal terminal.

An embodiment of the present disclosure also provides a display device including a display substrate including multiple sub-pixels, wherein at least one of the sub-pixels is provided with the driving circuit and the element to be driven according to any one of the above, and the driving circuit is configured to provide a driving signal to the element to be driven.

An embodiment of the present disclosure also provides a driving method of a driving circuit for driving the driving circuit according to any one of the above. Herein the gray scale control sub-circuit includes a first control sub-circuit and a second control sub-circuit, and the driving circuit has multiple scanning periods; in one of the multiple scanning periods, the driving method includes: providing a first working voltage to the first working voltage terminal, a first scanning signal to the first scanning signal terminal, and a display data signal to the first data signal terminal, wherein the display data signal is written into the second node through the writing sub-circuit, the driving sub-circuit is turned on under control of the first node and the second node, and the compensation sub-circuit compensates the first node under control of the first working voltage terminal; providing a second scanning signal to the second scanning signal terminal, and a duration data signal to the second data signal terminal, to enable the second control sub-circuit to be turned on or off under control of the second scanning signal and the duration data signal, wherein the compensation sub-circuit compensates the first node again under control of the first scanning signal terminal; providing a driving control signal to the driving control signal terminal, and the first working voltage being transmitted to the fourth node through the first control sub-circuit, to enable the element to be driven to work based on the display data signal and the first working voltage under control of the driving control signal, the first scanning signal, the second scanning signal and the duration data signal.

In some possible implementations, the driving method further includes compensating, by the compensation sub-circuit, the first node again under control of the first scanning signal terminal until a voltage value of a signal of the first node is an ideal voltage value which is equal to a sum of a voltage value of the first data signal terminal and a threshold voltage of a driving transistor.

Other aspects will become apparent after the drawings and the detailed description are read and understood.

BRIEF DESCRIPTION OF DRAWINGS

The accompanying drawings are used to provide an understanding of solutions of embodiments of the present disclosure, constitute a part of the specification to explain technical solutions of the present disclosure together with embodiments of the present disclosure, and do not constitute limitations on the technical solutions of embodiments of the present disclosure.

DETAILED DESCRIPTION

Hereinafter embodiments of the present disclosure will be described in detail with reference to the accompanying drawings. The embodiments and features in the embodiments in the present disclosure may be combined randomly if there is no conflict.

Unless otherwise defined, technical terms or scientific terms used in the embodiments of the present disclosure shall have common meanings as construed by those of ordinary skills in the art to which the present disclosure pertains. The words "first", "second" and the like used in the embodiments of the present disclosure do not represent any order, quantity or importance, but are merely used to distinguish among different components. Similar words such as "including" or "containing" mean that elements or articles appearing before the word cover elements or articles listed after the word and their equivalents, without excluding other elements or articles.

Those skilled in the art may understand that transistors used in all embodiments of the present disclosure may be thin film transistors or field-effect transistors or other devices with same characteristics. In some exemplary embodiments, the thin film transistor used in the embodiments of the present disclosure may be an oxide semiconductor transistor. Since a source and a drain of a transistor used here are symmetrical, the source and the drain may be interchanged. In the embodiments of the present disclosure, one of two electrodes of the transistor other than a gate is referred to as a first electrode and the other electrode is referred to as a second electrode to distinguish the two electrodes. The first electrode may be a source or a drain, and the second electrode may be a drain or a source.

Micro LEDs of some display panels are driven by pixel circuits to emit light. In some pixel circuits, threshold voltage compensation of a driving transistor is performed by adopting self-feedback turned-off of the driving transistor. With the progress of compensation of the threshold voltage Vth, a gate-source voltage Vgs decreases, which leads to weakening of compensation effect and incomplete compensation, thereby affecting accurate control of gray scale and further the display effect.

Figure 1:
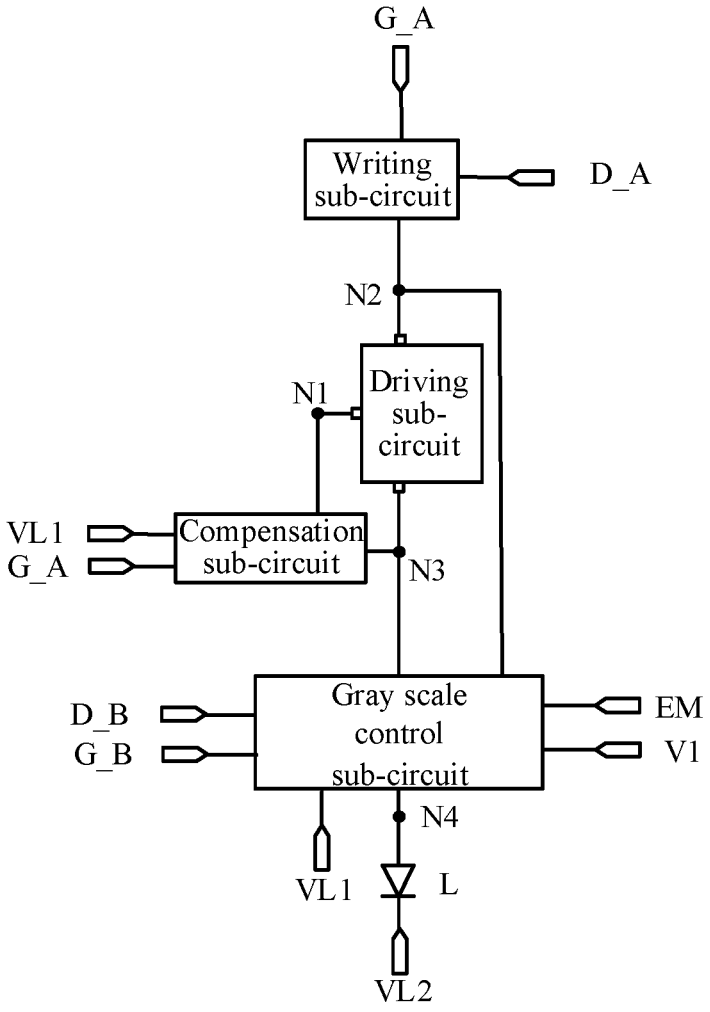
FIG. 1 is a schematic diagram one of structure of an exemplary driving circuit according to an embodiment of the present disclosure.

An embodiment of the present disclosure provides a driving circuit for driving an element to be driven to work. FIG. 1 is a schematic diagram of structure of a driving circuit provided by an embodiment of the present disclosure. As shown in FIG. 1, the driving circuit and the element to be driven L are connected in series between a first working voltage terminal VL1 and a second working voltage terminal VL2, and the driving circuit is configured to control formation of a current path between the first working voltage terminal VL1 and the second working voltage terminal VL2.

In some exemplary embodiments, the element to be driven L may be a light emitting element, for example a micro light emitting diode (such as a Micro LED). An anode of the element to be driven L is connected with a fourth node N4, and a cathode of the element to be driven L is connected with the second working voltage terminal VL2. The size level of the Micro LED is micron (μm) level. The embodiment of the present disclosure is described by taking the element to be driven L as a light emitting element as an example. It can be understood that the element to be driven L may be other current controlled electronic components.

As shown in FIG. 1, the driving circuit provided by the embodiment of the present disclosure includes a driving sub-circuit, a writing sub-circuit, a compensation sub-circuit and a gray scale control sub-circuit.

The driving sub-circuit is connected with a first node N1, a second node N2 and a third node N3 respectively, and is configured to provide a driving current to the third node N3 under control of the first node N1 and the second node N2. The writing sub-circuit is connected with a first scanning signal terminal G_A, a first data signal terminal D_A and the second node N2 respectively, and is configured to write a signal of the first data signal terminal D_A (i.e., a first data voltage $V_{D_A}$) into the second node N2 under control of the first scanning signal terminal G_A. The compensation sub-circuit is connected with the first working voltage terminal VL1, the first scanning signal terminal G_A, the first node N1 and the third node N3 respectively, and is configured to compensate the first node N1 under control of the first scanning signal terminal G_A and the first working voltage terminal VL1. The gray scale control sub-circuit is connected with the first working voltage terminal VL1, a light emitting control terminal EM (as a driving control signal terminal), the second node N2, the third node N3, the fourth node N4, a second scanning signal terminal G_B, a second data signal terminal D_B and a first voltage terminal V1 respectively, and is configured to provide a driving current to the fourth node N4 under control of the light emitting control terminal EM, the second scanning signal terminal G_B and the second data signal terminal D_B to control a turned-on duration of the current path.

In summary, the writing sub-circuit can output the first data voltage $V_{D_A}$ related to the display of gray scale to the driving sub-circuit, so that the driving sub-circuit can generate a driving current I for driving the light emitting element L to emit light. In addition, the gray scale control sub-circuit can control the turned-on duration of the current path formed when the driving current I flows into the light emitting element L, thereby controlling a light emitting duration of the light emitting element L. As the size and turned-on duration of the driving current I affect effective brightness of the light emitting element L, the effective brightness of the light emitting element L can be controlled by the gray scale control sub-circuit and the size of the first data voltage $V_{D_A}$ in a scanning period, to achieve the purpose of adjusting the display of gray scale. According to the embodiment of the disclosure, since each driving circuit is provided with a gray scale control sub-circuit, and for multiple driving circuits corresponding to subpixels in the same row, each gray scale control sub-circuit included is connected with different data signal lines (i.e., controlled by second data voltages $V_{D_B}$ which are independent of each other), the driving circuit provided by the embodiment of the disclosure can directly control the brightness of the light emitting element L (e.g., Micro LED) in the driving circuit independently. In addition, the driving circuit provided by the embodiment of the present disclosure may be manufactured on a glass substrate or a resin substrate in a display panel of a display device through a patterning process. An implementation of a Micro LED display device with lower cost, simple manufacturing process and mass production can be provided, when the light emitting element L is the Micro LED.

According to the driving circuit provided by the embodiment of the present disclosure, the compensation sub-circuit can compensate the first node N1 under control of the first scanning signal terminal G_A and the first working voltage terminal VL1, so that the accurate control of gray scale is realized, and the display quality of the display panel is improved.

In an embodiment of the present disclosure, the driving circuit is configured to provide the driving current I and control the turned-on duration of the current path between the first working voltage terminal VL1 and the second working voltage terminal VL2.

When the current path is turned on, a first working voltage VDD output by the first working voltage terminal VL1 and a second working voltage VSS output by the second working voltage terminal VL2 may provide a potential difference to the current path, so that the driving current I can be transmitted to the light emitting element L along the current path.

In some exemplary embodiments, the first working voltage VDD may be a constant high level, and the second working voltage VSS may be a constant low level.

The light emitting element L is configured to receive the driving current I in the current path and emit light.

Figure 2:
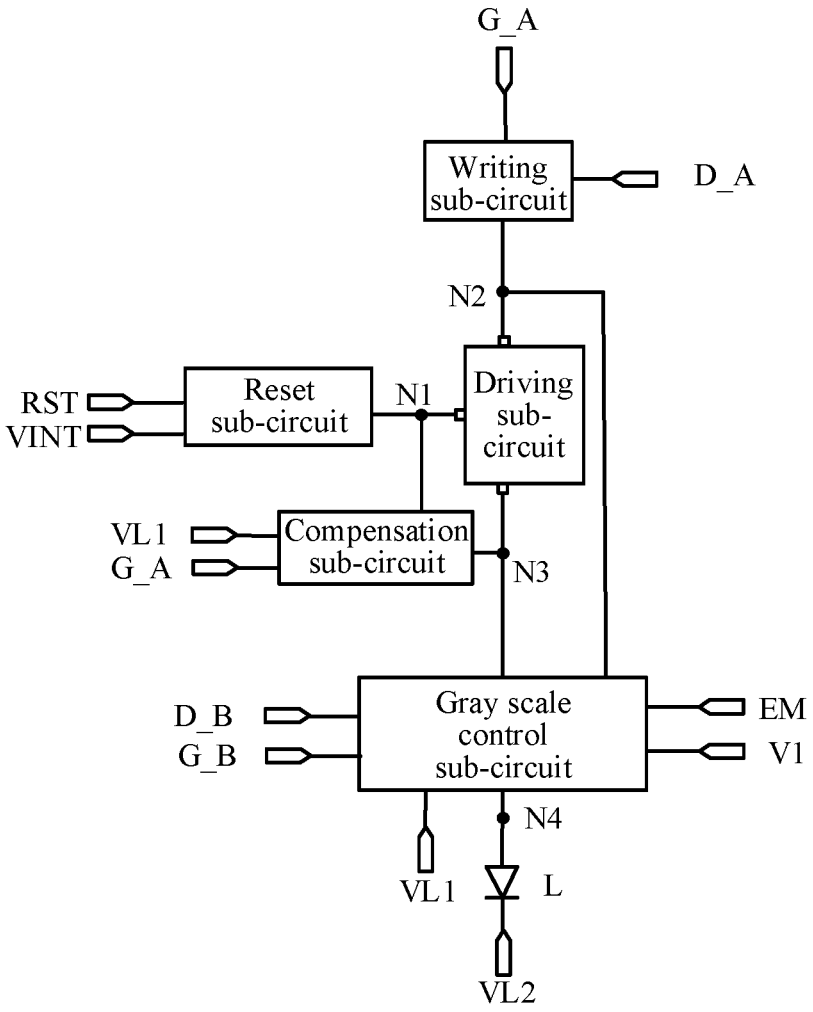
FIG. 2 is a schematic diagram two of structure of an exemplary driving circuit according to an embodiment of the present disclosure.

In some exemplary embodiments, as shown in FIG. 2, the driving circuit may further include a reset sub-circuit.

The reset sub-circuit is connected with a reset control signal terminal RST, the reset voltage terminal VINT and the first node N1 respectively, and is configured to write a signal of the reset voltage terminal VINT into the first node N1 under control of the reset control signal terminal RST.

The reset sub-circuit may reset a gate of a driving transistor Td, to avoid the influence of a voltage of a previous frame image remaining on the drive transistor Td on the display of a present image frame. At this time, the voltage of the first node N1 is a reset voltage provided by the reset voltage terminal VINT.

Figure 3:
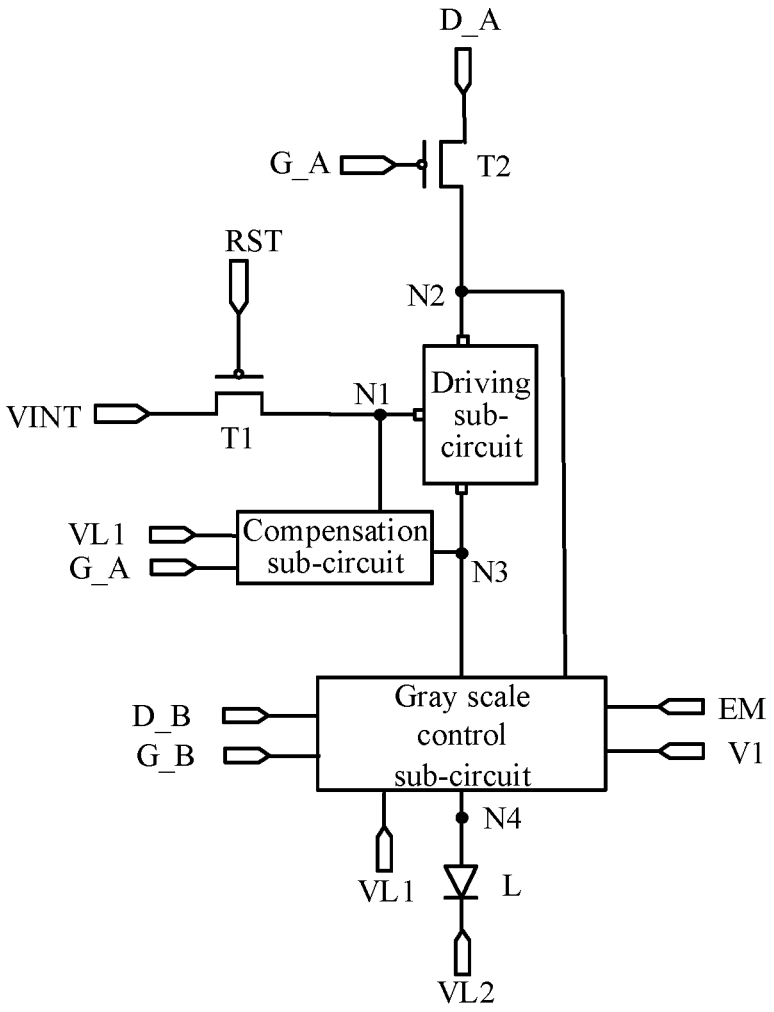
FIG. 3 is an equivalent circuit diagram of a reset sub-circuit and a writing sub-circuit provided by an embodiment of the present disclosure.

In some exemplary embodiments, FIG. 3 is an equivalent circuit diagram of a reset sub-circuit and a writing sub-circuit provided by an embodiment of the present disclosure. As shown in FIG. 3, the reset sub-circuit provided by an embodiment of the present disclosure includes a first transistor T1, and the writing sub-circuit includes a second transistor T2.

A control electrode of the first transistor T1 is connected with a reset control signal terminal RST, a first electrode of the first transistor T1 is connected with a reset voltage terminal VINT, and a second electrode of the first transistor T1 is connected with a first node N1. A control electrode of the second transistor T2 is connected with a first scanning signal terminal G_A, a first electrode of the second transistor T2 is connected with a first data signal terminal D_A, and a second electrode of the second transistor T2 is connected with a second node N2.

An exemplary structure of a reset sub-circuit and a write sub-circuit is shown in FIG. 3. Those skilled in the art may easily understand that implementations of the reset sub-circuit and the writing sub-circuit are not limited thereto as long as their respective functions can be realized.

Figure 4:
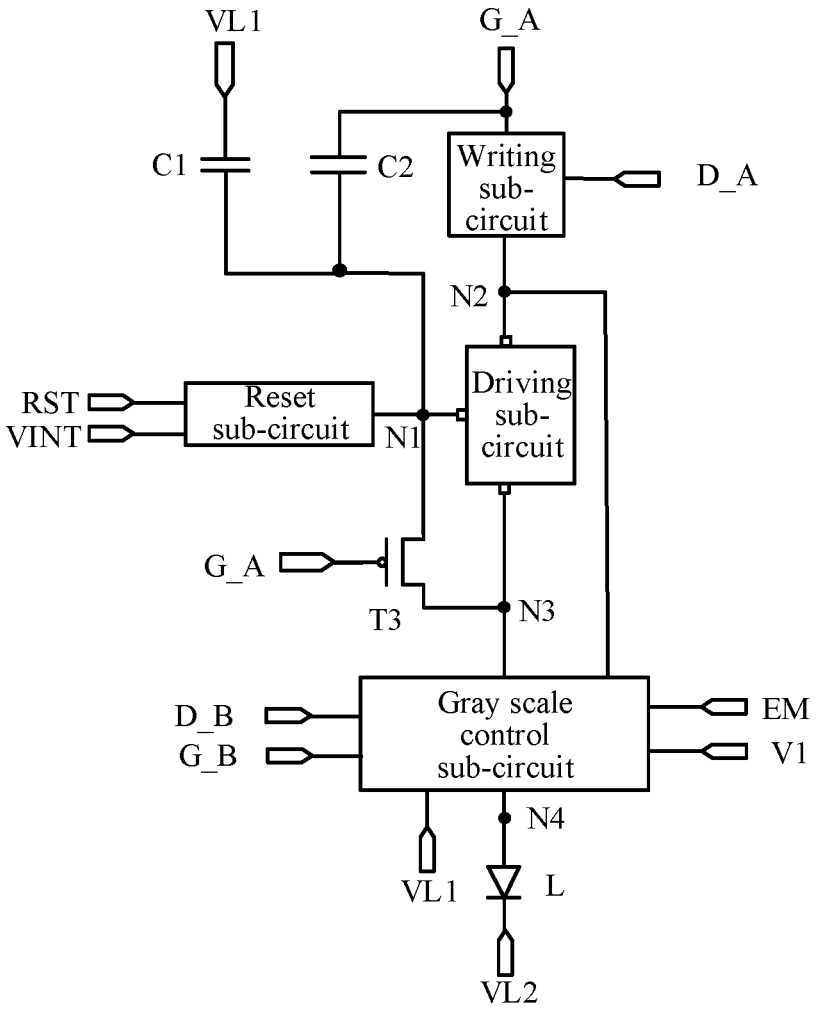
FIG. 4 is an equivalent circuit diagram of a compensation sub-circuit provided by an embodiment of the present disclosure.

In some exemplary embodiments, FIG. 4 is an equivalent circuit diagram of a compensation sub-circuit provided by an embodiment of the present disclosure. As shown in FIG. 4, the compensation sub-circuit provided by the embodiment of the present disclosure includes a third transistor T3, a first capacitor C1 and a second capacitor C2.

A control electrode of the third transistor T3 is connected with the first scanning signal terminal G_A, a first electrode of the third transistor T3 is connected with a first node N1, and a second electrode of the third transistor T3 is connected with a third node N3.

One terminal of the first capacitor C1 is connected with the first node N1, and the other terminal of the first capacitor C1 is connected with the first working voltage terminal VL1.

One terminal of the second capacitor C2 is connected with the first node N1, and the other terminal of the second capacitor C2 is connected with the first scanning signal terminal G_A.

An exemplary structure of a compensation sub-circuit is shown in FIG. 4. Those skilled in the art may easily understand that implementations of the compensation sub-circuit are not limited to this as long as its functions can be achieved.

Figure 5:
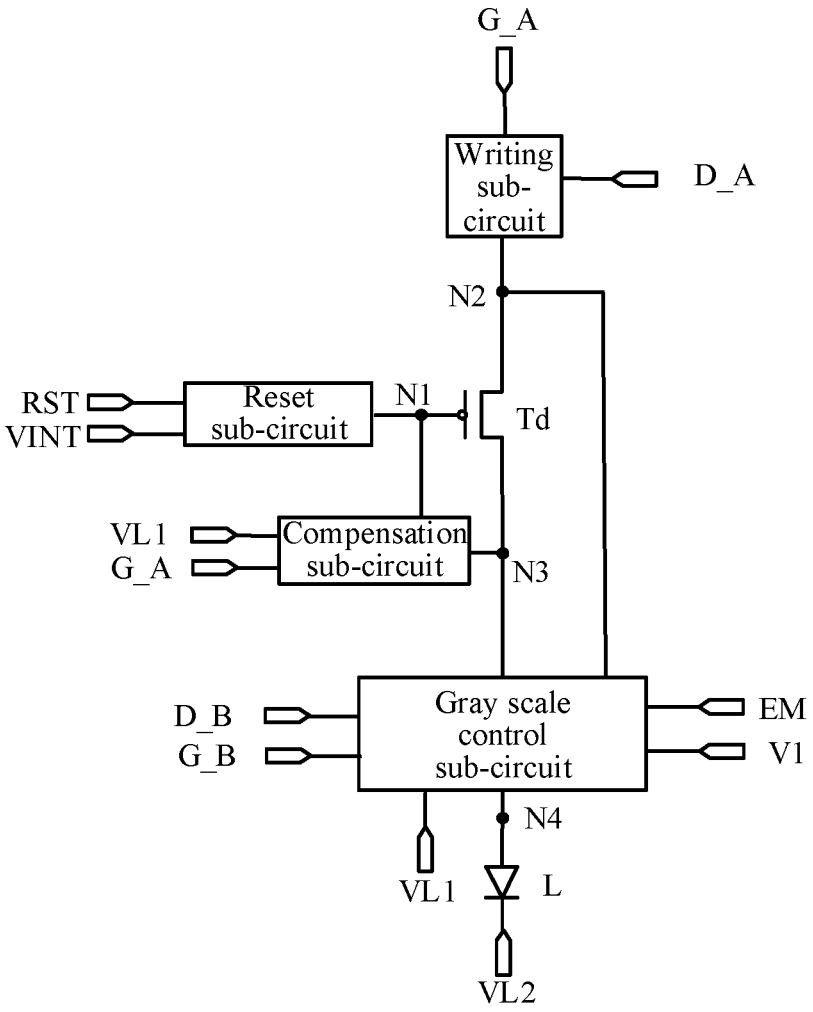
FIG. 5 is an equivalent circuit diagram of a driving sub-circuit provided by an embodiment of the present disclosure.

In some exemplary embodiments, FIG. 5 is an equivalent circuit diagram of a driving sub-circuit provided by an embodiment of the present disclosure. As shown in FIG. 5, the driving sub-circuit provided by the embodiment of the present disclosure includes a driving transistor Td.

A control electrode of the driving transistor Td is connected with a first node N1, a first electrode of the driving transistor Td is connected with a second node N2, and a second electrode of the driving transistor Td is connected with a third node N3.

An exemplary structure of the driving sub-circuit is shown in FIG. 5. Those skilled in the art may easily understand that implementations of the driving sub-circuit are not limited to this as long as its functions can be achieved.

In some exemplary embodiments, the compensation sub-circuit is configured to compensate the first node N1 under control of a first scanning signal terminal G_A and a first working voltage terminal VL1 until a voltage value of a signal of the first node N1 is an ideal voltage value which is equal to a sum of a voltage value $V_{D_A}$ of the first data signal terminal and a threshold voltage Vth of the driving transistor.

Figure 6:
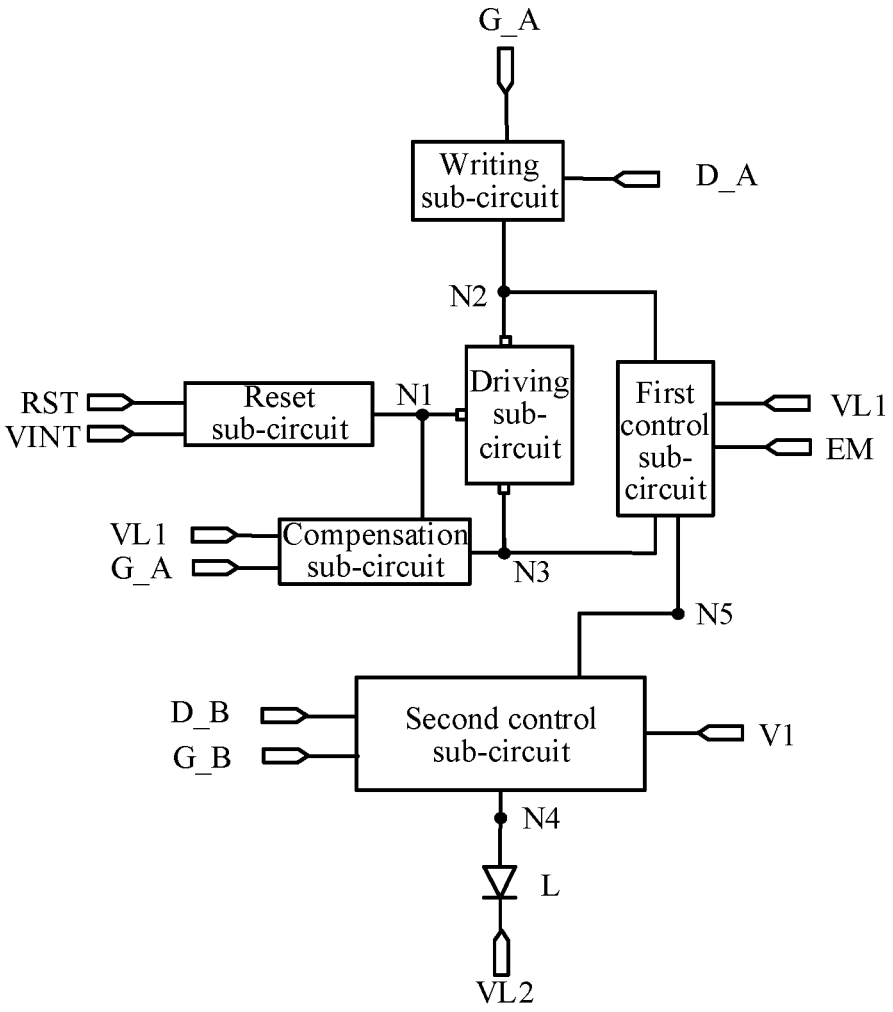
FIG. 6 is a schematic diagram of structure of a gray scale control sub-circuit provided by an embodiment of the present disclosure.

In some exemplary embodiments, as shown in FIG. 6, a gray scale control sub-circuit includes a first control sub-circuit and a second control sub-circuit.

The first control sub-circuit is connected with a first working voltage terminal VL1, a light emitting control terminal EM, a second node N2, a third node N3 and a fifth node N5 respectively, and is configured to provide a signal of the first working voltage terminal VL1 to the second node N2 and a signal of the third node N3 to the fifth node N5 under control of a light emitting control terminal EM.

The second control sub-circuit is connected with a fourth node N4, the fifth node N5, a second scanning signal terminal G_B, a second data signal terminal D_B and a first voltage terminal V1 (which may be a ground terminal GND), and is configured to provide a signal of the fifth node N5 to the fourth node N4 under control of the second scanning signal terminal G_B and the second data signal terminal D_B.

It can be seen from the above that only when both the first control sub-circuit and the second control sub-circuit are in a turned-on state, the current path can be turned on, and the driving current I generated by the driving sub-circuit can be output to the light emitting element L through the current path. In this way, the effective light emitting brightness of the light emitting element L may be controlled cooperatively by the driving current I, the first control sub-circuit and the second control sub-circuit, which increases factors affecting the effective light emitting brightness of the light emitting element L, so that gray scale values displayed by sub-pixels with this driving circuit are more diversified.

Figure 7:
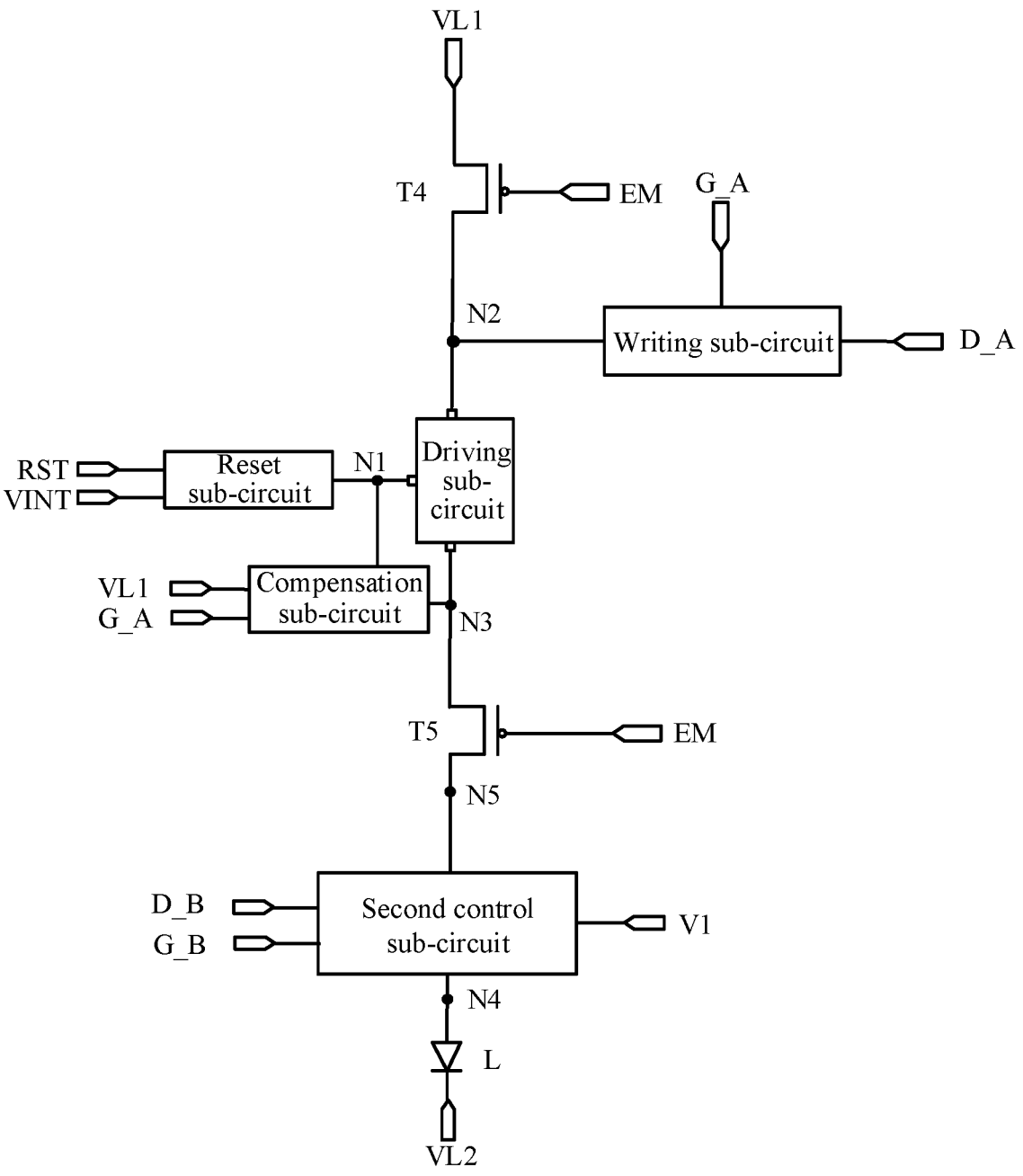
FIG. 7 is an equivalent circuit diagram of a first control sub-circuit provided by an embodiment of the present disclosure.

In some exemplary embodiments, FIG. 7 is an equivalent circuit diagram of a first control sub-circuit provided by an embodiment of the present disclosure. As shown in FIG. 7, the first control sub-circuit provided by the embodiment of the present disclosure includes a fourth transistor T4 and a fifth transistor T5.

A control electrode of the fourth transistor T4 is connected with a light emitting control terminal EM, a first electrode of the fourth transistor T4 is connected with a first working voltage terminal VL1, and a second electrode of the fourth transistor T4 is connected with a second node N2. A control electrode of the fifth transistor T5 is connected with the light emitting control terminal EM, a first electrode of the fifth transistor T5 is connected with the third node N3, and a second electrode of the fifth transistor T5 is connected with a fifth node N5.

An exemplary structure of the first control sub-circuit is shown in FIG. 7. Those skilled in the art may easily understand that implementations of the first control sub-circuit are not limited to this as long as its functions can be achieved.

Figure 8:
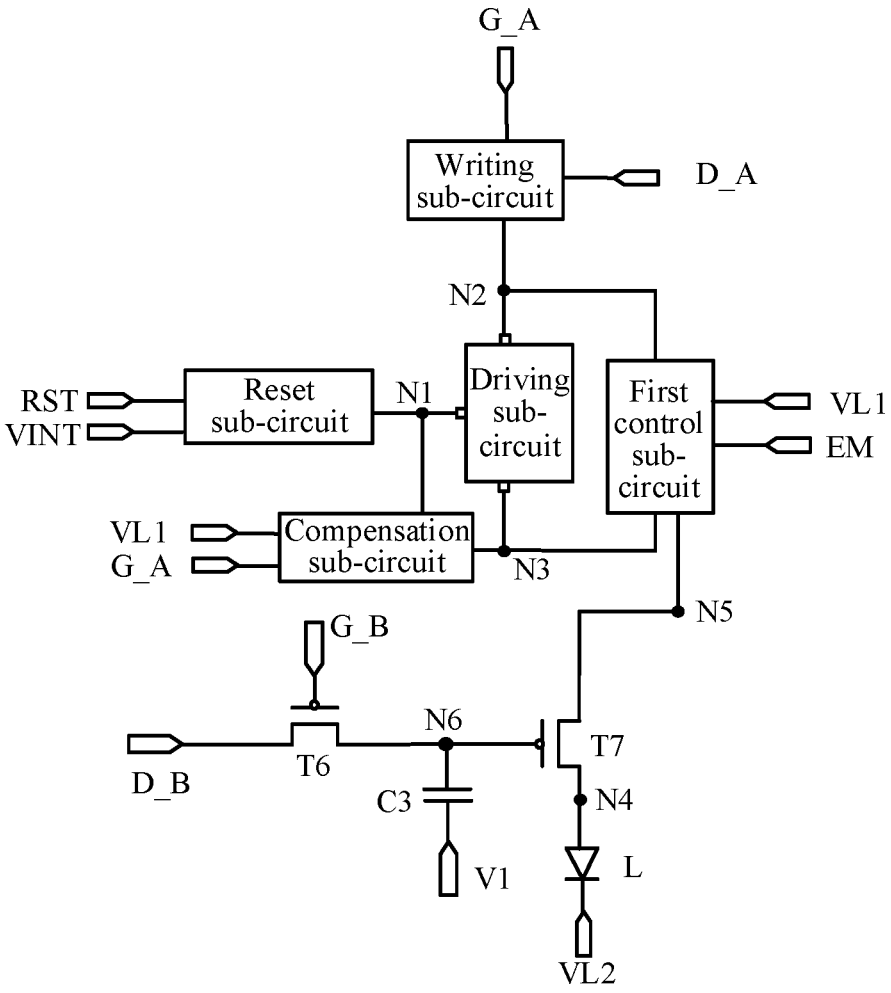
FIG. 8 is an equivalent circuit diagram of a second control sub-circuit provided by an embodiment of the present disclosure.

In some exemplary embodiments, FIG. 8 is an equivalent circuit diagram of a second control sub-circuit provided by an embodiment of the present disclosure. As shown in FIG. 8, the second control sub-circuit provided by the embodiment of the present disclosure includes a third capacitor C3, a sixth transistor T6 and a seventh transistor T7.

A control electrode of the sixth transistor T6 is connected with a second scanning signal terminal G_B, a first electrode of the sixth transistor T6 is connected with a second data signal terminal D_B, and a second electrode of the sixth transistor T6 is connected with a sixth node N6. A control electrode of the seventh transistor T7 is connected with a sixth node N6, a first electrode of the seventh transistor T7 is connected with a fifth node N5, and a second electrode of the seventh transistor T7 is connected with a fourth node N4. One terminal of the third capacitor C3 is connected with the sixth node N6, and the other terminal of the third capacitor C3 is connected with the first voltage terminal V1.

An exemplary structure of the second control sub-circuit is shown in FIG. 8. Those skilled in the art may easily understand that implementations of the second control sub-circuit are not limited to this as long as its functions can be achieved.

Figure 9:
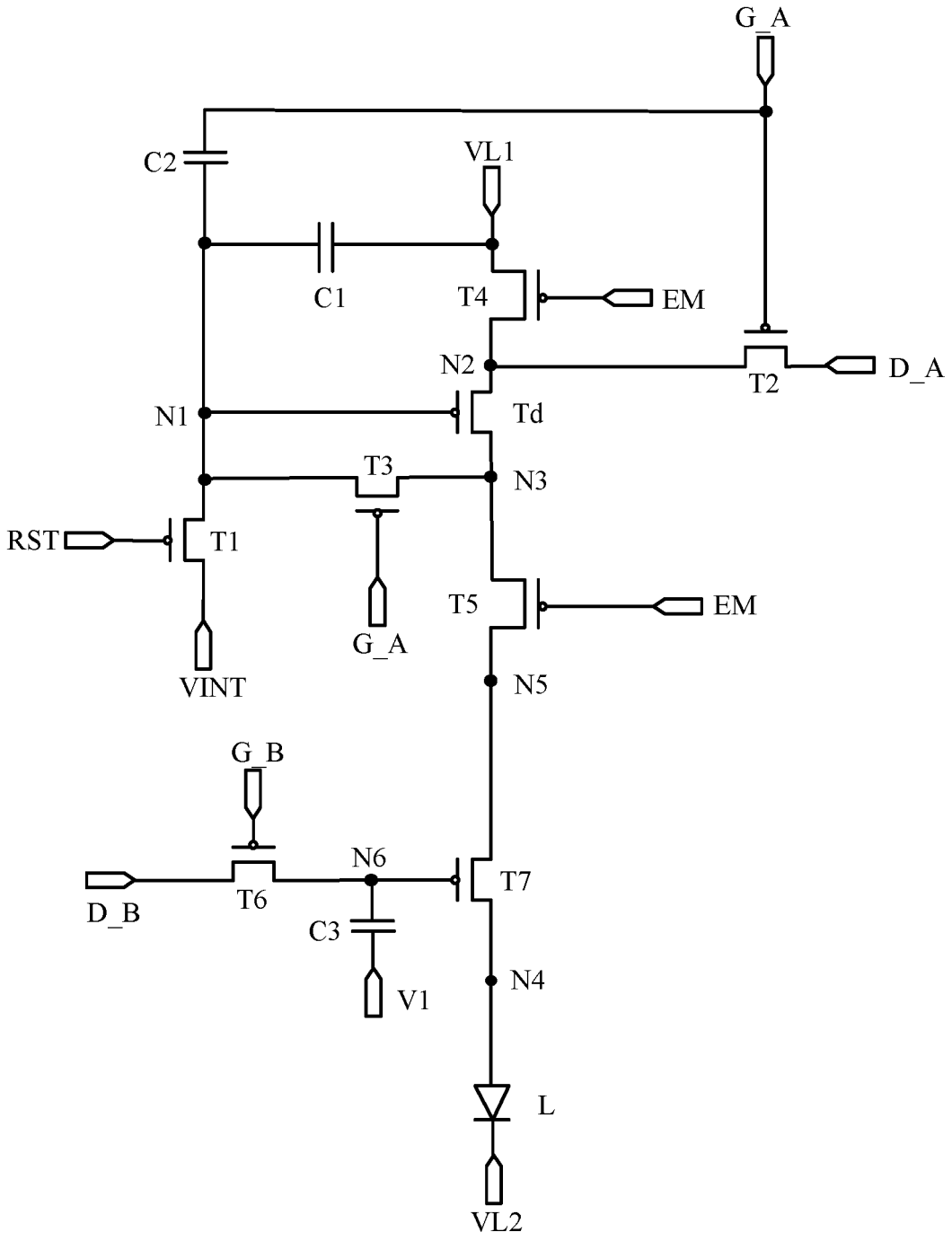
FIG. 9 is an equivalent circuit diagram of a driving circuit provided by an embodiment of the present disclosure.

In some exemplary embodiments, FIG. 9 is an equivalent circuit diagram of a driving circuit provided by an embodiment of the present disclosure. As shown in FIG. 9, in the driving circuit provided by the embodiment of the present disclosure, a reset sub-circuit includes a first transistor T1; a writing sub-circuit includes a second transistor T2; a compensation sub-circuit includes a third transistor T3, a first capacitor C1 and a second capacitor C2; a driving sub-circuit includes a driving transistor Td; a first control sub-circuit includes a fourth transistor T4 and a fifth transistor T5; and a second control sub-circuit includes a third capacitor C3, a sixth transistor T6 and a seventh transistor T7.

A control electrode of the first transistor T1 is connected with a reset control signal terminal RST, a first electrode of the first transistor T1 is connected with a reset voltage terminal VINT, and a second electrode of the first transistor T1 is connected with a first node N1. A control electrode of the second transistor T2 is connected with the first scanning signal terminal G_A, a first electrode of the second transistor T2 is connected with a first data signal terminal D_A, and a second electrode of the second transistor T2 is connected with a second node N2. A control electrode of the third transistor T3 is connected with the first scanning signal terminal G_A, a first electrode of the third transistor T3 is connected with the first node N1, and a second electrode of the third transistor T3 is connected with a third node N3. One terminal of the first capacitor C1 is connected with the first node N1, and the other terminal of the first capacitor C1 is connected with a first working voltage terminal VL1. One terminal of the second capacitor C2 is connected with the first node N1, and the other terminal of the second capacitor C2 is connected with the first scanning signal terminal G_A. A control electrode of the driving transistor Td is connected with the first node N1, a first electrode of the driving transistor Td is connected with the second node N2, and a second electrode of the driving transistor Td is connected with the third node N3. A control electrode of the fourth transistor T4 is connected with the light emitting control terminal EM, a first electrode of the fourth transistor T4 is connected with the first working voltage terminal VL1, and a second electrode of the fourth transistor T4 is connected with the second node N2. A control electrode of the fifth transistor T5 is connected with the light emitting control terminal EM, a first electrode of the fifth transistor T5 is connected with the third node N3, and a second electrode of the fifth transistor T5 is connected with a fifth node N5. A control electrode of the sixth transistor T6 is connected with a second scanning signal terminal G_B, a first electrode of the sixth transistor T6 is connected with a second data signal terminal D_B, and a second electrode of the sixth transistor T6 is connected with a sixth node N6. A control electrode of the seventh transistor T7 is connected with the sixth node N6, a first electrode of the seventh transistor T7 is connected with the fifth node N5, and a second electrode of the seventh transistor T7 is connected with the fourth node N4. One terminal of the third capacitor C3 is connected with the sixth node N6, and the other terminal of the third capacitor C3 is connected with the first voltage terminal V1.

FIG. 9 shows an exemplary structure of the driving sub-circuit, the reset sub-circuit, the writing sub-circuit, the compensation sub-circuit, the first control sub-circuit and the second control sub-circuit in the driving circuit. Those skilled in the art may easily understand that implementations of the above various sub-circuits are not limited thereto as long as their respective functions can be realized.

In some exemplary embodiments, a capacitance value of the first capacitor C1 and a capacitance value of the second capacitor C2 satisfy C2/(C1+C2)=ΔV/ΔVg, where ΔV is a difference between an actual voltage value and an ideal voltage value of the first node N1 after the first node N1 is compensated, and the ideal voltage value of the first node N1 is equal to the sum of the voltage value $V_{D_A}$ of the first data signal terminal D_A and the threshold voltage Vth of the driving transistor, and ΔVg is a kickback voltage value of the first scanning signal terminal G_A.

The compensation sub-circuit of the embodiment of the present disclosure includes a second capacitor C2. In a compensation phase, the signal of the first data signal terminal D_A is written into the second node N2 through the second transistor T2, and the voltage ($V_{D_A}$+Vth) of the third node N3 is written into the first node N1 through the third transistor T3, that is, the first node N1 is charged, where Vth is a threshold voltage of the driving transistor Td. A charging speed of the first node N1, that is, the magnitude of a charging current of the first node N1 depends on the turned-on state of the driving transistor Td, which is controlled by a voltage difference between a gate and a source of the driving transistor Td. With the progress of compensation, a voltage $V_{N1}$ of the first node N1 gradually approaches ($V_{D_A}$+Vth), and the closer it approaches ($V_{D_A}$+Vth), the slower the charging speed of the first node N1 is. The voltage $V_{N1}$ of the first node N1 cannot be charged to ($V_{D_A}$+Vth) for a limited time (for example, 1H, 1H represents a charging time of one row of pixels). Assuming that a difference between the voltage $V_{N1}$ of the first node N1 and ($V_{D_A}$+Vth) is ΔV, i.e., the first node N1 is charged to ($V_{D_A}$+Vth−ΔV). For different gray scales, the brightness differences caused by the difference voltage ΔV are different. In a duration data signal writing sub-phase, a level input by the first scanning signal terminal G_A changes from low to high. Assuming that the kickback voltage of the first scanning signal terminal G_A is ΔVg, the potential of the first node N1 is pulled up by the second capacitor C2 connected with the first node N1, thereby compensating the difference voltage ΔV.

In this embodiment, the first transistor T1 to the seventh transistor T7 and the driving transistor Td may all be N-type thin film transistors or P-type thin film transistors, which can unify the process flow, reduce the number of the processes, and be benefit to improving the yield of products. Considering that a leakage current of a low-temperature polysilicon thin film transistor is smaller, all transistors of the embodiment of the present disclosure may be low-temperature polysilicon thin film transistors, and the thin film transistors with a bottom gate structure or the thin film transistors with a top gate structure may be selected for thin film transistors, as long as a switch function can be realized.

In an exemplary embodiment, the first capacitor C1 to the third capacitor C3 may be liquid crystal capacitors each of which is composed of a pixel electrode and a common electrode, or may be liquid crystal capacitors each of which is composed of a pixel electrode and a common electrode and equivalent capacitors each of which is composed of a storage capacitor, and the present disclosure is not limited thereto.

Taking a working procedure of a first-stage driving circuit as an example, the technical solution of an embodiment of the present disclosure is illustrated below through the working procedure of the driving circuit.

Figure 10:
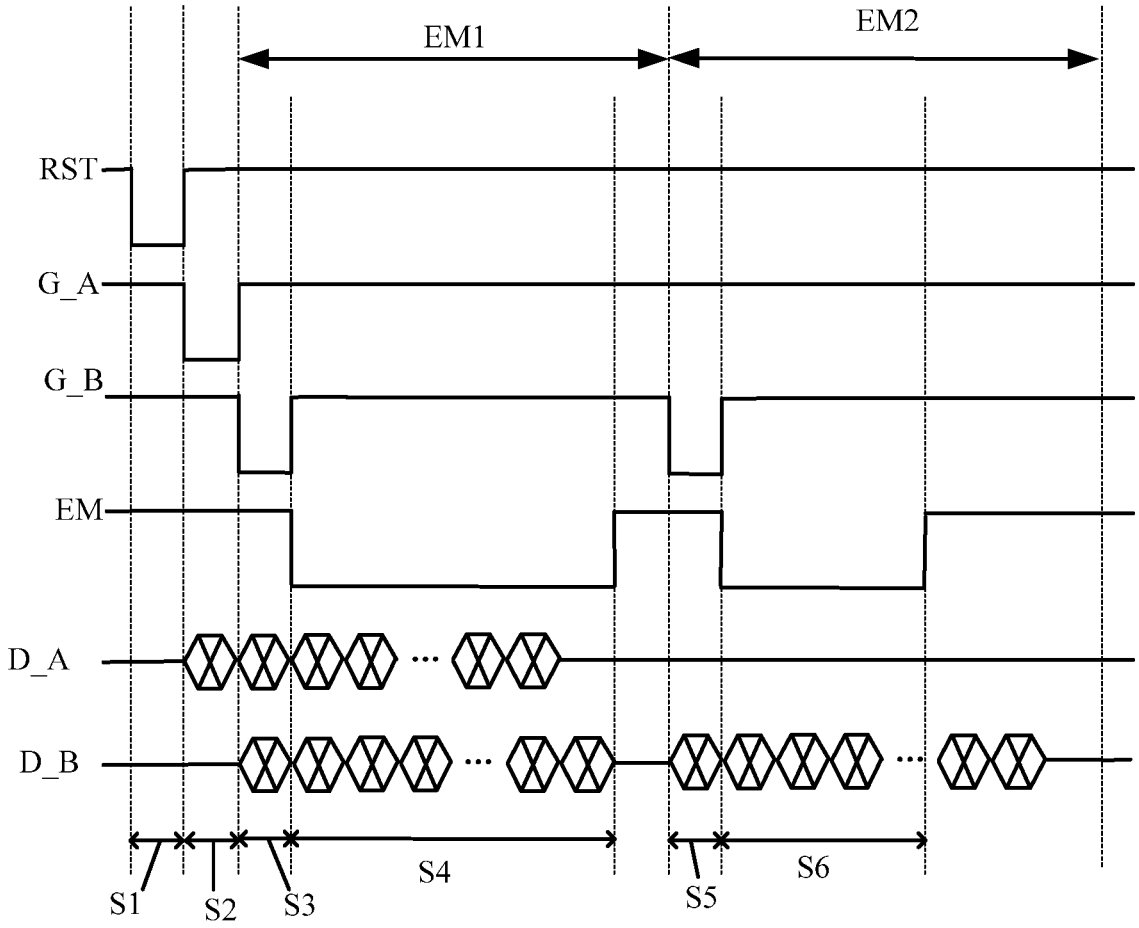
FIG. 10 is a working timing diagram of an exemplary driving circuit according to an embodiment of the present disclosure.

Taking the transistors T1 to T7 and Td in the driving circuit provided by the embodiment of the present disclosure as P-type thin film transistors as an example, FIG. 10 is a working timing diagram of a driving circuit provided by an embodiment of the present disclosure. As shown in FIG. 9 and FIG. 10, the driving circuit provided by the embodiment of the present disclosure includes eight transistor units (T1 to T7 and Td), three capacitor units (C1 to C3), seven signal input terminals (G_A, G_B, RST, D_A, D_B, VINT and EM) and three power supply terminals (VL1, VL2 and V1), FIG. 9 also shows a light emitting element L for convenience of description.

As shown in FIG. 9, the driving circuit is electrically connected with an anode of the light emitting element L and drives the light emitting element L to emit light, and a cathode of the light emitting element L is connected with a second working voltage terminal VL2. The driving circuit is configured to drive the light emitting element L to emit light. The driving circuit and the light emitting element L are connected in series between a first working voltage terminal VL1 and the second working voltage terminal VL2, and the driving circuit is configured to control formation of a current path between the first working voltage terminal VL1 and the second working voltage terminal VL2. The driving circuit includes a driving sub-circuit, a writing sub-circuit, a compensation sub-circuit and a gray scale control sub-circuit. In this embodiment, the cathode of the light emitting element L may also be connected with the first voltage terminal V1 (common voltage line) to receive a common voltage provided by the first voltage terminal V1, for example, the cathode of the light emitting element L is grounded.

A working principle of the driving circuit shown in FIG. 9 will be illustratively explained below with reference to FIG. 10.

As shown in FIG. 10, in a procedure of displaying a frame of image, the driving circuit has a reset phase S1, a compensation phase S2, and multiple light emitting phases EM1 to EMn, which may be sequentially set in time. As shown in FIG. 9, each light emitting phase includes duration data signal writing sub-phases S3, S5 . . . , and effective light emitting sub-phases S4, S6 . . . .

In the reset phase S1, an input signal of the reset control signal terminal RST is at a low level, the first transistor T1 is turned on, and a signal of the reset voltage terminal RST is provided to the first node N1 to reset the first node N1 in preparation for turning on the driving transistor Td in the compensation phase.

In the compensation phase S2, an input signal of a first scanning signal terminal G_A is at a low level, the second transistor T2 and the third transistor T3 are turned on, and the second transistor T2 writes a display data signal of a first data signal terminal D_A into the second node N2. Since a voltage difference between a signal of the first node N1 and a signal of the second node N2 is smaller than a threshold voltage Vth of the driving transistor Td, the driving transistor Td is turned on. The first node N1, the second node N2 and the third node N3 conduct mutually, and the first working voltage terminal VL1 charges the first node N1. At this time, a voltage value $V_{N1}$ of the signal of the first node N1 is equal to $V_{D_A}$±Vth-AV.

A charging speed of the first node N1 depends on the turned-on state of the driving transistor Td, which is controlled by a voltage difference between the gate and the source of the driving transistor Td. In this case, the voltage difference between the gate and the source is ($V_{N1}$−$V_{D_A}$), where $V_{N1}$ is the voltage value of the signal of the first node N1. With the progress of compensation, the voltage $V_{N1}$ of the first node N1 gradually approaches ($V_{D_A}$+Vth), and the closer it approaches ($V_{D_A}$+Vth), the slower the charging speed of the first node N1 is. The voltage \$T_M$ of the first node N1 cannot be charged to ($V_{D_A}$+Vth) for a limited time (for example, a charging time 1H of a row of pixels). Assuming that a difference between the voltage $V_{N1}$ of the first node N1 and ($V_{D_A}$+Vth) is ΔV, i.e., the first node N1 is charged to ($VD_{D_A}$+Vth−ΔV). For different gray scales, the brightness differences caused by the difference voltage ΔV are different.

In the duration data signal writing sub-phase S3, an input signal of the second scanning signal terminal G_B is at a low level, and the sixth transistor T6 is turned on. The sixth transistor T6 writes a duration data signal of the second data signal terminal D_B into the sixth node N6 and stores it in the third capacitor C3. Whether the seventh transistor T7 is turned on or off depends on the duration data signal stored in the third capacitor C3. For example, when the duration data signal is at an effective level (e.g., a low level), the seventh transistor T7 is turned on.

In the duration data signal writing sub-phase S3, a level of an input signal of the first scanning signal terminal G_A changes from low to high. Assuming that a kickback voltage value of the first scanning signal terminal G_A is ΔVg, the potential of the first node N1 is pulled up by the second capacitor C2 connected with the first node N1, thereby compensating the difference voltage ΔV. Assuming that a kickback potential value of the first node N1 caused by the kickback voltage value ΔVg of the first scanning signal terminal G_A is $\Delta V_{N1}$, the magnitude of $\Delta V_{N1}$ is (C2*ΔVg)/(C1+C2). Let (C2*ΔVg)/(C1+c2)=ΔV, then get C2/(C1+C2)=ΔV/ΔVg, so the capacitance value of the first capacitor C1 and the capacitance value the second capacitor C2 are set according to this ratio during designing the circuit. Under a usual case, ΔVg is more than ten volts, such as 14 volts; ΔV is only a few tenths of a volt, for example, 0.2 volts, and the value of C2/(C1+C2) in the example is 0.2/14=1.4%. Since the capacitance value of the second capacitor C2 is small, the addition of the second capacitor C2 can improve the display effect without affecting the Pixels Per Inch (PPI).

In the effective light emitting sub-phase S4, an input signal of the light emitting control terminal EM is at a low level, so that the fourth transistor T4 and the fifth transistor T5 are turned on. In addition, the driving transistor Td is turned on, and a driving current Ids generated in the driving transistor Td satisfies the following expression:

$$\begin{aligned} Ids &= K(Vg - Vs - Vth)^2 \\ &= K((V_{D_A} + Vth) - VDD - Vth)^2 \\ &= K(V_{D_A} - VDD)^2; \end{aligned}$$

Here, K=½×W/L×C×μ, where W is a width of a channel of the driving transistor Td, L is a length of the channel of the driving transistor Td, W/L is a width to length ratio of the channel of the driving transistor (i.e., the ratio of width to length), μ is an electron mobility, and C is a capacitance value per unit area.

When the seventh transistor T7 is turned on by the duration data signal, the driving current Ids generated in the driving transistor Td is supplied to the light emitting element L via the turned-on fifth transistor T5 and the turned-on seventh transistor T7. Since the driving current Ids generated in the driving transistor Td is uncorrelated with the threshold voltage Vth of the driving transistor Td, the gray scale accuracy of the pixel unit including the above driving circuit is improved.

As shown in FIG. 10, in a time length of a frame of image, a driving circuit includes multiple light emitting phases, for example, a first light emitting phase EM1, a second light emitting phase EM2, . . . , and an Nth light emitting phase EMn, and only two light emitting phases are shown in FIG. 10: the first light emitting phase EM1 and the second light emitting phase EM2. In each light emitting phase, a duty ratio of a light emitting control signal provided by the light emitting control terminal EM may be different.

In an embodiment, an overall brightness of a pixel unit including the driving circuit in a procedure of displaying a frame of image may be obtained by superposing light emitting brightnesses of the light emitting element L in the pixel sub-circuit in multiple light emitting phases. Accordingly, for each frame of image, the duration data signal writing operation may be performed for multiple times through the second control sub-circuit.

In this embodiment, the above driving circuit and the driving method of the driving circuit can make the Micro LED of the pixel unit working at a high current density display, for example, a low gray scale. For example, a low gray scale may be displayed by the pixel unit including the Micro LED by reducing a light emitting duration of the Micro LED working at the high current density. For example, a desired gray scale may be displayed by the pixel unit including the Micro LED by controlling the light emitting duration of the light emitting element L working at the high current density and/or a current density of the driving current.

Figure 11:
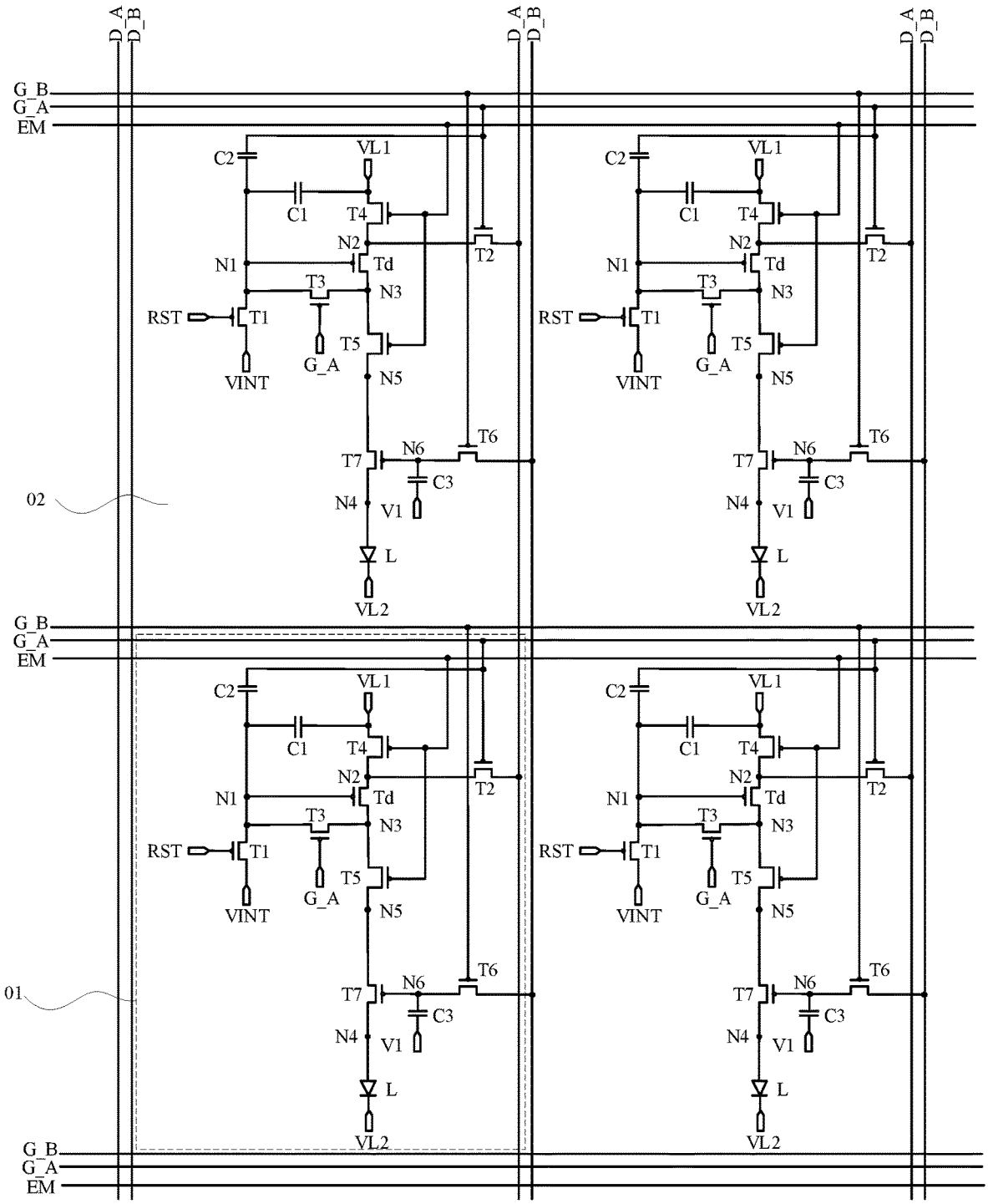
FIG. 11 is a schematic diagram of structure of an exemplary display panel according to an embodiment of the present disclosure.

Some embodiments of the present disclosure also provide a display device, which includes a display panel a display area of which has multiple sub-pixels 02 as shown in FIG. 11, and at least one sub-pixel 02 is provided with any one of the above driving circuits 01.

The sub-pixel 02 may be defined by a first scanning signal line G_A and a first data signal line D_A crossing horizontally and vertically. Furthermore, a second scanning signal line G_B may be arranged in parallel with the first scanning signal line G_A, and a second data signal line D_B may be arranged in parallel with the first data signal line D_A.

It can be seen from FIG. 11 that fourth transistors T4 in driving circuits 01 of the sub-pixels located in the same row are connected with the same light emitting control signal terminal EM. In this case, when the light emitting control signal terminal EM provides an effective signal, for example, a low level as shown in FIG. 10, multiple fourth transistors T4 and fifth transistors T5 in the same row are all turned on.

Therefore, in order to control the light emitting brightness of different sub-pixels in the same row independently, an effective signal input by the second scanning signal terminal G_B may control a sixth transistor T6 to be turned on, and then a seventh transistor T7 may be controlled to be turned on when a second data voltage Vdata_B provided by the second data signal terminal D_B is an effective signal after the sixth transistor T6 is turned on, so that a current path between a first working voltage terminal VL1 and a second working voltage terminal VL2 is turned on.

A driving current I generated by a driving transistor Td may be transmitted to a light emitting element L through the current path. The longer the duration for which the current path is turned on, the higher the effective light emitting brightness of the light emitting element L in one scanning period is. In addition, the magnitude of the driving current I may be adjusted by adjusting the magnitude of a first data voltage Vdata_A provided by a first data signal terminal D_A. The larger the driving current I is, the higher the effective light emitting brightness of the light emitting element L in one scanning period is.

According to an embodiment of the present disclosure, as shown in FIG. 10, there are multiple light emitting phases EM1 to EMn within one image frame. The light emitting phases are different from each other. Therefore, one or more corresponding light emitting phases can be selected according to desired light emitting duration of the light emitting element, so that the light emitting element emits light at the one or more light emitting phases, thereby obtaining multiple different gray scale brightnesses. According to another embodiment of the present disclosure, multiple light emitting phases of one image frame may be the same as each other. Therefore, one or more light emitting phases can be selected according to the desired light emitting duration of the light emitting element, so that the light emitting element emits light at the one or more light emitting phases, thereby multiple different gray scales can be obtained by changing the light emitting duration of the light emitting element.

It can be seen in a case that there are multiple light emitting phases in one image frame and the length of each light emitting phase is different, an adjustable range of light emitting duration and effective brightness of the light emitting element can be expanded, and the number of gray scales that can be displayed on the display panel can be enriched.

In summary, all sub-pixels in a row of driving circuits 01 can emit light at the same time under control of the light emitting control signal provided by the light emitting control signal terminal EM, but the light emitting brightness and light emitting duration of each sub-pixel cannot be controlled independently. However, according to the driving circuit provided by the embodiment of the present disclosure, the light emitting brightness of a single sub-pixel can be adjusted under cooperation of the light emitting control signal terminal EM, the first scanning signal terminal G_A, the second scanning signal terminal G_B, the first data signal terminal D_A and the second data signal terminal D_B.

The display device may be any product or component with display function, such as a display, a television, a digital photo frame, a mobile phone or a tablet computer. Herein, the display device has the same technical effect as the driving circuit 01 provided in any above embodiment, and will not be repeated here.

Some embodiments of the present disclosure further provide a driving method of a driving circuit, which is applied to the driving circuit provided in the previous embodiments. In an image frame, the driving circuit has multiple scanning periods. The gray scale control sub-circuit in the driving circuit includes a first control sub-circuit and a second control sub-circuit.

Figure 12:
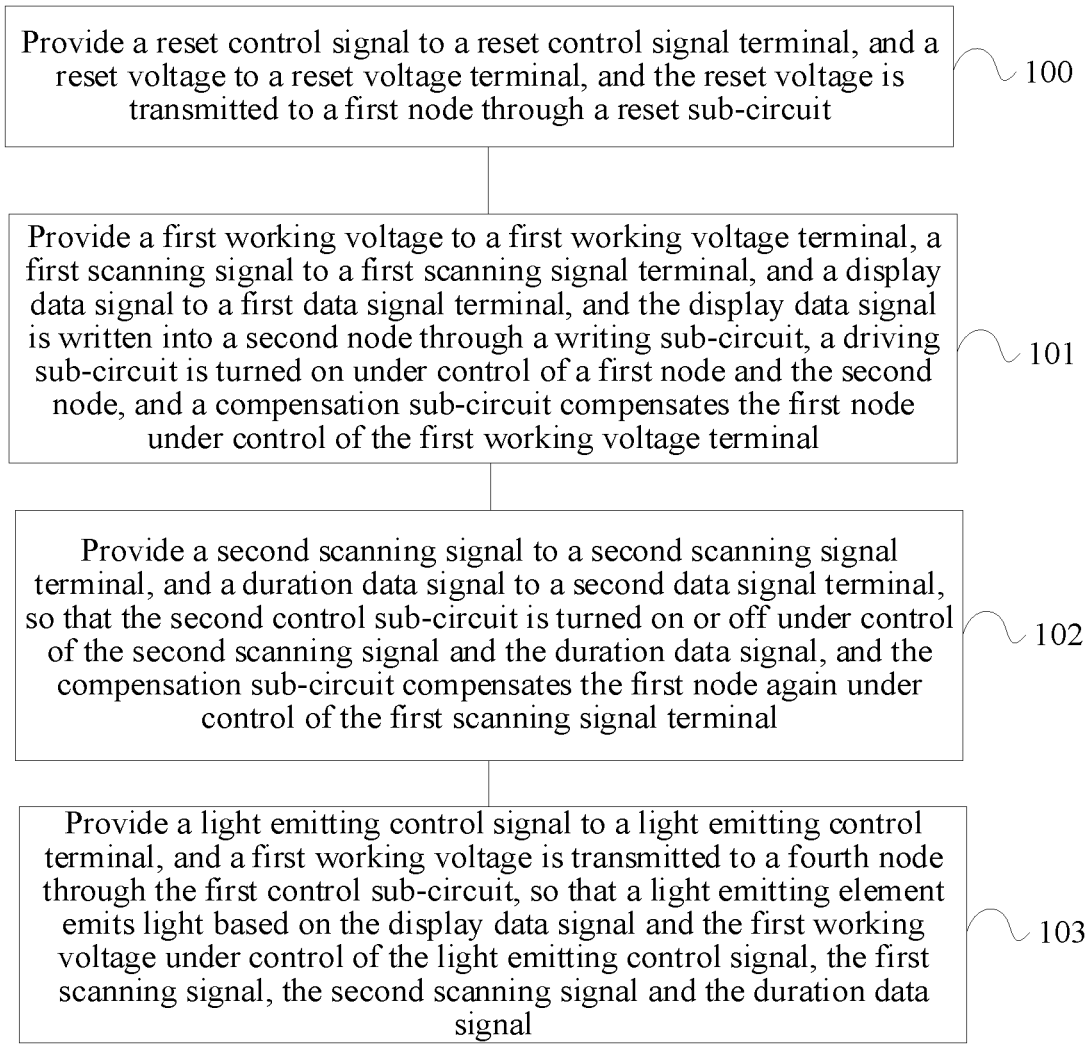
FIG. 12 is a flowchart of an exemplary driving method of a driving circuit according to an embodiment of the present disclosure.

In a scanning period S (for example, a first scanning period S1), a driving method of a driving circuit, as shown in FIG. 12, includes acts 100 to 103.

In act 101, a first working voltage is provided to a first working voltage terminal, a first scanning signal is provided to a first scanning signal terminal, and a display data signal is provided to a first data signal terminal, and is written into a second node through a writing sub-circuit, a driving sub-circuit is turned on under control of a first node and the second node, and a compensation sub-circuit compensates the first node under control of the first working voltage terminal.

In some exemplary embodiments, when the display data signal at the first data signal terminal is written into the driving sub-circuit, a voltage of the first node cannot be charged to a sum of a voltage value of the data signal terminal and a threshold voltage of the driving transistor within a limited time, assuming that a difference between the voltage of first node and the sum of the voltage value of the data signal terminal and the threshold voltage of the driving transistor is ΔV.

In act 102, a second scanning signal is provided to a second scanning signal terminal and a duration data signal is provide to a second data signal terminal, so that the second control sub-circuit is turned on or off under control of the second scanning signal and the duration data signal, and the compensation sub-circuit compensates the first node again under control of the first scanning signal terminal.

In some exemplary embodiments, the compensation sub-circuit compensates the first node again under control of the first scanning signal terminal until the voltage value of the signal of the first node is an ideal voltage value, which is equal to the sum of the voltage value of the first data signal terminal and the threshold voltage of the driving transistor.

In some exemplary embodiments, assuming that a kick-back voltage value of the first scanning signal terminal is ΔVg, the potential of the first node is pulled up by $(C2*\Delta Vg)/(C1+C2)$ through the second capacitor connected with the control terminal of the driving sub-circuit, thereby compensating the difference voltage ΔV, where C2 is a capacitance value of the second capacitor, and C1 is a capacitance value of the first capacitor.

In act 103, a light emitting control signal is provided to a light emitting control terminal, and the first working voltage is transmitted to a fourth node through the first control sub-circuit, so that the light emitting element emits light based on the display data signal and the first working voltage under control of the light emitting control signal, the first scanning signal, the second scanning signal and the duration data signal.

In some exemplary embodiments, a driving current Ids generated by the driving sub-circuit is provided to the light emitting element L via the gray scale control sub-circuit.

In addition, when the driving circuit also includes a reset sub-circuit, the driving method of the driving circuit before act 101, as shown in FIG. 12, further includes act 100.

In act 100, a reset control signal is provided to a reset control signal terminal, and a reset voltage is provided to a reset voltage terminal, and the reset voltage is transmitted to the first node through a reset sub-circuit.

In some exemplary embodiments, the reset voltage may be a low level, so that the driving transistor is in a state in which the driving transistor is nearly turned on but is not turned on, thus preparing for charging a gate of the driving transistor during the following data writing phase, thus the first data voltage provided by the first data signal terminal can charge the gate of the driving transistor more quickly. Therefore, during the subsequent data writing phase, when different data voltages are written into the driving transistor, writing time of the data voltages can be reduced, therefore, for all driving circuits of the entire display panel, response times of all driving transistors are almost the same, and the writing times of the data voltages are approximately the same. For the entire display panel, this arrangement makes the display effect more uniform.

According to the technical solutions provided by the present disclosure, the first node is compensated through the compensation sub-circuit under control of the first scanning signal terminal and the first working voltage terminal, so that the accurate control of gray scale is realized, and the display quality of the display panel is improved.

The following several points need to be explained.

The accompanying drawings of the embodiments of the present disclosure only involve structures involved in the embodiments of the present disclosure, and other structures may refer to general designs.

The embodiments of the present disclosure, i.e., the features in the embodiments may be combined with each other to obtain new embodiments where there is no conflict.

Although the embodiments disclosed in the present disclosure are as described above, the described contents are only the embodiments for facilitating understanding of the present disclosure, which are not intended to limit the present disclosure. A person skilled in the art to which the present disclosure pertains can make any modifications and variations in the form and details of implementations without departing from the spirit and scope disclosure by the present disclosure. Nevertheless, the scope of patent protection of the present disclosure shall still be determined by the scope defined by the appended claims.

What we claim is:

1. A driving circuit, used for driving an element to be driven to work, wherein the driving circuit and the element to be driven are connected in series between a first working voltage terminal and a second working voltage terminal, and the driving circuit is configured to control formation of a current path between the first working voltage terminal and the second working voltage terminal;

the driving circuit comprises a driving sub-circuit, a writing sub-circuit, a compensation sub-circuit and a gray scale control sub-circuit, wherein:

the driving sub-circuit is connected with a first node, a second node, and a third node respectively, and is configured to provide a driving current to the third node under control of the first node and the second node;

the writing sub-circuit is connected with a first scanning signal terminal, a first data signal terminal and the second node respectively, and is configured to write a signal of the first data signal terminal into the second node under control of the first scanning signal terminal;

the compensation sub-circuit is connected with the first working voltage terminal, the first scanning signal terminal, the first node and the third node respectively, and is configured to compensate the first node under control of the first scanning signal terminal and the first working voltage terminal; and the gray scale control sub-circuit is connected with a driving control signal terminal, the first working voltage terminal, the second node, the third node, a fourth node, a second scanning signal terminal, the second data signal terminal and a first voltage terminal, respectively, and is configured to provide a driving current to the fourth node under control of the driving control signal terminal, the second scanning signal terminal and the second data signal terminal to control a turned-on duration of the current path.

2. The driving circuit according to claim 1, further comprising a reset sub-circuit; wherein the reset sub-circuit is connected with a reset control signal terminal, a reset voltage terminal and the first node respectively, and is configured to write a signal of the reset voltage terminal into the first node under control of the reset control signal terminal.

3. The driving circuit according to claim 2, wherein the reset sub-circuit comprises a first transistor, and the writing sub-circuit comprises a second transistor, wherein a control electrode of the first transistor is connected with the reset control signal terminal, a first electrode of the first transistor is connected with the reset voltage terminal, and a second electrode of the first transistor is connected with the first node; and a control electrode of the second transistor is connected with the first scanning terminal, a first electrode of the second transistor is connected with the first data signal terminal, and a second electrode of the second transistor is connected with the second node.

4. The driving circuit according to claim 3, wherein the element to be driven is a micro light emitting diode, an anode of the element to be driven is connected with the fourth node, and a cathode of the element to be driven is connected with the second working voltage terminal.

5. The driving circuit according to claim 2, wherein the element to be driven is a micro light emitting diode, an anode of the element to be driven is connected with the fourth node, and a cathode of the element to be driven is connected with the second working voltage terminal.

6. The driving circuit according to claim 2, wherein the compensation sub-circuit comprises a third transistor, a first capacitor and a second capacitor, wherein a control electrode of the third transistor is connected with the first scanning signal terminal, a first electrode of the third transistor is connected with the first node, and a second electrode of the third transistor is connected with the third node;

one terminal of the first capacitor is connected with the first node, and the other terminal of the first capacitor is connected with the first working voltage terminal; and one terminal of the second capacitor is connected with the first node, and the other terminal of the second capacitor is connected with the first scanning signal terminal.

7. The driving circuit according to claim 2, wherein the driving sub-circuit comprises a driving transistor, a control electrode of the driving transistor is connected with the first node, a first electrode of the driving transistor is connected with the second node, and a second electrode of the driving transistor is connected with the third node.

8. The driving circuit according to claim 2, wherein the gray scale control sub-circuit comprises a first control sub-circuit and a second control sub-circuit, wherein the first control sub-circuit is connected with the first working voltage terminal, the driving control signal terminal, the second node, the third node and a fifth node respectively, and is configured to provide a signal of the first working voltage terminal to the second node and a signal of the third node to the fifth node under control of the driving control signal terminal; and the second control sub-circuit is connected with the fourth node, the fifth node, the second scanning signal terminal, the second data signal terminal and the first voltage terminal respectively, and is configured to provide a signal of the fifth node to the fourth node under control of the second scanning signal terminal and the second data signal terminal.

9. The driving circuit according to claim 1, wherein the element to be driven is a micro light emitting diode, an anode of the element to be driven is connected with the fourth node, and a cathode of the element to be driven is connected with the second working voltage terminal.

10. The driving circuit according to claim 1, wherein the compensation sub-circuit comprises a third transistor, a first capacitor and a second capacitor, wherein a control electrode of the third transistor is connected with the first scanning signal terminal, a first electrode of the third transistor is connected with the first node, and a second electrode of the third transistor is connected with the third node;

one terminal of the first capacitor is connected with the first node, and the other terminal of the first capacitor is connected with the first working voltage terminal; and one terminal of the second capacitor is connected with the first node, and the other terminal of the second capacitor is connected with the first scanning signal terminal.

11. The driving circuit according to claim 1, wherein the driving sub-circuit comprises a driving transistor, a control electrode of the driving transistor is connected with the first node, a first electrode of the driving transistor is connected with the second node, and a second electrode of the driving transistor is connected with the third node.

12. The driving circuit according to claim 1, wherein the gray scale control sub-circuit comprises a first control sub-circuit and a second control sub-circuit, wherein the first control sub-circuit is connected with the first working voltage terminal, the driving control signal terminal, the second node, the third node and a fifth node respectively, and is configured to provide a signal of the first working voltage terminal to the second node and a signal of the third node to the fifth node under control of the driving control signal terminal; and the second control sub-circuit is connected with the fourth node, the fifth node, the second scanning signal terminal, the second data signal terminal and the first voltage terminal respectively, and is configured to provide a signal of the fifth node to the fourth node under control of the second scanning signal terminal and the second data signal terminal.

13. The driving circuit according to claim 12, wherein the first control sub-circuit comprises a fourth transistor and a fifth transistor, wherein a control electrode of the fourth transistor is connected with the driving control signal terminal, a first electrode of the fourth transistor is connected with the first working voltage terminal, and a second electrode of the fourth transistor is connected with the second node; and a control electrode of the fifth transistor is connected with the driving control signal terminal, a first electrode of the fifth transistor is connected with the third node, and a second electrode of the fifth transistor is connected with the fourth node.

14. The driving circuit according to claim 12, wherein the second control sub-circuit comprises a sixth transistor, a third capacitor and a seventh transistor, wherein a control electrode of the sixth transistor is connected with the second scanning signal terminal, a first electrode of the sixth transistor is connected with the second data signal terminal, and a second electrode of the sixth transistor is connected with a sixth node;

one terminal of the third capacitor is connected with the sixth node, and the other terminal of the third capacitor is connected with the first working voltage terminal; and a control electrode of the seventh transistor is connected with the sixth node, a first electrode of the seventh transistor is connected with the fourth node, and a second electrode of the seventh transistor is connected with the fifth node.

15. The driving circuit according to claim 1, further comprising a reset sub-circuit, wherein the gray scale control sub-circuit comprises a first control sub-circuit and a second control sub-circuit; the reset sub-circuit comprises a first transistor; the writing sub-circuit comprises a second transistor; the compensation sub-circuit comprises a third transistor, a first capacitor and a second capacitor; and the driving sub-circuit comprises a driving transistor; the first control sub-circuit comprises a fourth transistor and a fifth transistor; and the second control sub-circuit comprises a sixth transistor, a third capacitor and a seventh transistor, wherein a control electrode of the first transistor is connected with a reset control signal terminal, a first electrode of the first transistor is connected with a reset voltage terminal, and a second electrode of the first transistor is connected with the first node;

a control electrode of the second transistor is connected with the first scanning signal terminal, a first electrode of the second transistor is connected with the first data signal terminal, and a second electrode of the second transistor is connected with the second node;

a control electrode of the third transistor is connected with the first scanning signal terminal, a first electrode of the third transistor is connected with the first node, and a second electrode of the third transistor is connected with the third node;

one terminal of the first capacitor is connected with the first node, and the other terminal of the first capacitor is connected with the first working voltage terminal;

one terminal of the second capacitor is connected with the first node, and the other terminal of the second capacitor is connected with the first scanning signal terminal;

a control electrode of the driving transistor is connected with the first node, a first electrode of the driving transistor is connected with the second node, and a second electrode of the driving transistor is connected with the third node;

a control electrode of the fourth transistor is connected with the driving control signal terminal, a first electrode of the fourth transistor is connected with the first working voltage terminal, and a second electrode of the fourth transistor is connected with the second node;

a control electrode of the fifth transistor is connected with the driving control signal terminal, a first electrode of the fifth transistor is connected with the third node, and a second electrode of the fifth transistor is connected with the fifth node;

a control electrode of the sixth transistor is connected with the second scanning signal terminal, a first electrode of the sixth transistor is connected with the second data signal terminal, and a second electrode of the sixth transistor is connected with a sixth node;

one terminal of the third capacitor is connected with the sixth node, and the other terminal of the third capacitor is connected with the first working voltage terminal; and a control electrode of the seventh transistor is connected with the sixth node, a first electrode of the seventh transistor is connected with the fifth node, and a second electrode of the seventh transistor is connected with the fourth node.

16. The driving circuit according to claim 15, wherein the first capacitor and the second capacitor satisfy $C2/(C1+C2)=\Delta V/\Delta Vg$;

wherein C1 is a capacitance value of the first capacitor, C2 is a capacitance value of the second capacitor, $\Delta V$ is a difference between an actual voltage value and an ideal voltage value of the first node after the first node is compensated, and ΔVg is a kickback voltage value of the first scanning signal terminal.

17. A display device comprising a display substrate including a plurality of sub-pixels, wherein at least one of the sub-pixels is provided with the driving circuit and the element to be driven according to claim 1, and the driving circuit is configured to provide a driving signal to the element to be driven.

18. A driving method of a driving circuit, used for driving the driving circuit according to claim 1, wherein the gray scale control sub-circuit comprises a first control sub-circuit and a second control sub-circuit, and the driving circuit has a plurality of scanning periods; in one of the plurality of scanning periods, the driving method comprises:

providing a first working voltage to the first working voltage terminal, a first scanning signal to the first scanning signal terminal, and a display data signal to the first data signal terminal, wherein the display data signal is written into the second node through the writing sub-circuit, the driving sub-circuit is turned on under control of the first node and the second node, and the compensation sub-circuit compensates the first node under control of the first working voltage terminal;

providing a second scanning signal to the second scanning signal terminal, and a duration data signal to the second data signal terminal, to enable the second control sub-circuit to be turned on or off under control of the second scanning signal and the duration data signal, and the compensation sub-circuit compensating the first node again under control of the first scanning signal terminal; and providing a driving control signal to the driving control signal terminal, and the first working voltage being transmitted to the fourth node through the first control sub-circuit, to enable the element to be driven to work based on the display data signal and the first working voltage under control of the driving control signal, the first scanning signal, the second scanning signal and the duration data signal.

19. The driving method of the driving circuit according to claim 18, further comprising: compensating, by the compensation sub-circuit, the first node again under control of the first scanning signal terminal until a voltage value of a signal of the first node is an ideal voltage value which is equal to a sum of a voltage value of the first data signal terminal and a threshold voltage of a driving transistor.

20. The driving method of the driving circuit according to claim 18, further comprising: providing a reset control signal to a reset control signal terminal, and a reset voltage to a reset voltage terminal, wherein the reset voltage is transmitted to the first node through a reset sub-circuit.

* * * * *